United States Patent [19]

Aulbach et al.

[11] Patent Number: 5,062,434

[45] Date of Patent: Nov. 5, 1991

[54] CIGARETTE PAPER

[75] Inventors: Paul L. Aulbach; Dorothy M. Frank; David S. Roth, all of Louisville, Ky.

[73] Assignee: Brown & Williamson Tobacco Corporation, Louisville, Ky.

[21] Appl. No.: 411,177

[22] Filed: Sep. 22, 1989

[51] Int. Cl.[5] ..... A24D 1/02

[52] U.S. Cl. ..... 131/336; 131/365

[58] Field of Search ..... 131/336, 365

[56] References Cited

U.S. PATENT DOCUMENTS 3,394,708 7/1968 Grassi ..... 131/336

3,426,761 2/1969 Fernandez ..... 131/336

4,174,719 11/1979 Martin et al. ..... 131/336

4,253,476 3/1981 Sato ..... 131/336

FOREIGN PATENT DOCUMENTS 0257144 10/1981 Austria .

*Primary Examiner*—V. Millin

*Attorney, Agent, or Firm*—Charles G. Lamb

[57] ABSTRACT

A cigarette wrapping paper includes a plurality of rows of perforations extending across the width of the paper wherein the rows of perforations are spaced at preselected distances along the entire length of the paper.

5 Claims, 1 Drawing Sheet

CIGARETTE PAPER

BACKGROUND OF THE INVENTION (1) Field of the Invention

This invention relates to paper wrappers for cigarettes. In one aspect it relates to cigarette paper with novel ventilating air means therein. In another aspect, it relates to a cigarette paper useful to control the amount of air to the tobacco column of a cigarette. In even another aspect, the invention relates to a cigarette having controllable, reduced tar deliveries.

(2) Description of the Prior Art

It is well known in the art to perforate papers useable as cigarette wrappers for a tobacco column. However, the commercially available papers are provided with longitudinally extending lines of perforations along the entire length of the paper so that when in use the perforations run the length of the tobacco column. There have also been many means suggested for adjusting the air flow through a cigarette to control the tar or smoke deliveries exiting the mouth end of the cigarette. For example, U.S. Pat. No. 3,503,406 teaches a filtered cigarette with perforations through the tipping paper and a perforated sleeve concentrically located over the filter. The sleeve also is perforated and by rotating the sleeve the perforations through the sleeve are brought into and out of registration with the perforations in the tipping to adjust the air flow into the filter. U.S. Pat. No. 3,860,011 teaches a filtered cigarette having a perforated tipping pap(r to provide for the flow of ventilatinq air into the filter. And, in U.S. Pat. No 3,910,287, specifically FIG. 1, rolls of perforations through the tobacco column wrapping paper, approximate the end of the tobacco column are provided so that when the tobacco column is ignited, the perforations provide for increased air flow into the tobacco column. U.S. Pat. No. 3,911,932 teaches a cigarette providing for the flow of ambient air into the tobacco column by having a porous paper wrapper circumscribing the tobacco column, and an outer porous wrapper circumscribing a portion of the length of the wrapped tobacco column. The outer wrapper has a lower porosity than does the inner paper wrapper. Other references which teach filtered cigarettes having perforations in the tipping paper over the filter include U.S. Pat. No. 4,338,907; U.S. Pat. No. 4,365,641; U.S. Pat. No. 4,481,960; and, U.S. Pat. No. 4,593,707.

SUMMARY OF THE INVENTION

The present invention advantageously provides a straight forward arrangement of an improved wrapping paper for a tobacco forward arrangement of an improved wrapping paper for a tobacco column having a specific perforation pattern to provide diluting air to cigarettes. The present invention further provides means for controlled smoke deliveries on both filtered and non-filtered cigarettes by preselected perforations of the cigarette paper across the width of the paper at approximately equal intervals. The present invention even further provides a cigarette wrapping paper with perforations at predetermined intervals wherein registration of the paper on a cigarette making machine is not required.

More particularily, the present invention provides a cigarette paper comprising a plurality of rows of perforations extending across the width of the paper, the rows of perforations being spaced at preselected distances along the entire length of the paper.

It is to be understood that the description of the examples of the present invention given hereinafter are not by way of limitation and various modifications within the scope of the present invention will occur to those skilled in the art upon leading the disclosure set forth hereinafter.

BRIEF DESCRIPTION OF THE DRAWINGS

Referring to the drawings.

DESCRIPTION OF THE PREFERRED EMBODIMENTS

Figure 1:
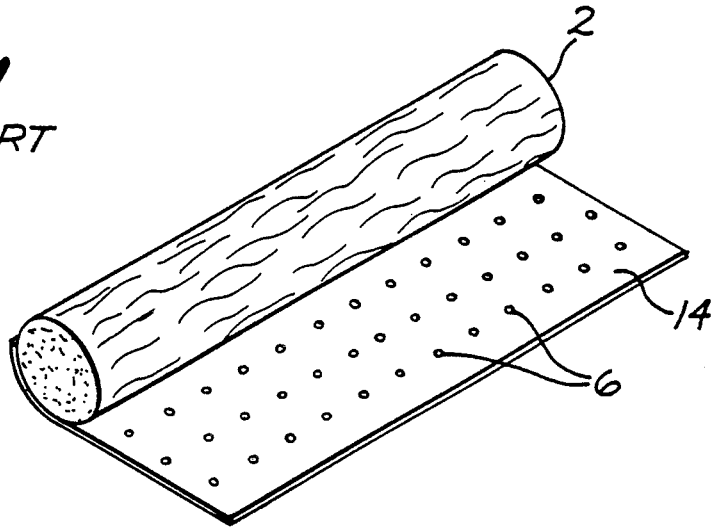
FIG. 1 PRIOR ART
FIG. 1 is a perspective view of a tobacco rod wrapper in commercially available wrapping paper.

In FIG. 1, a rod of tobacco 2 is wrapped by a commercially available wrapping paper having a plurality of aperatures 6 therethrough. The perforations 6 are provided in a plurality of longitudinally extending rows down the paper.

Figure 2:
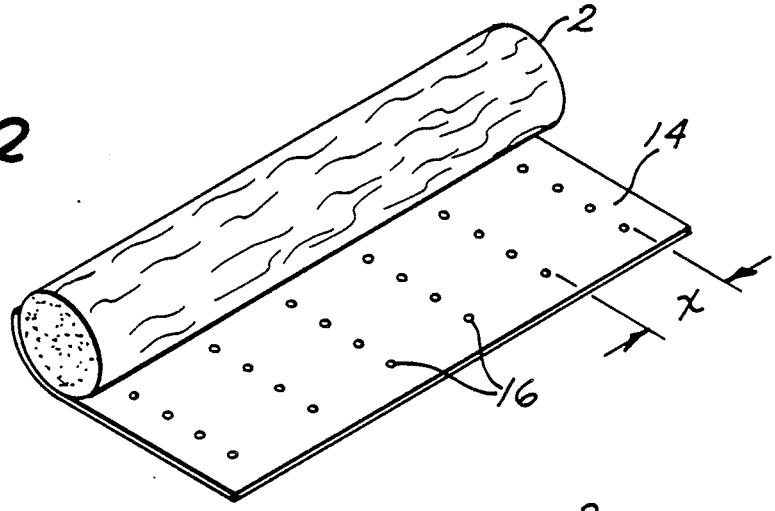
FIG. 2 is a perspective view of a tobacco rod wrapped with one preferred cigarette wrapper of the present invention; and, FIG. 3 is a prespective view of a tobacco rod wrapped with even another preferred cigarette wrapper of the present invention.

In FIG. 2, a tobacco rod 2 is circumscribed by a wrapping paper 14 having a plurality of perforations 16 herein. The pattern of the perforations in FIG. 2 are in a plurality of latitudinally spaced rows of perforations across the paper wherein the distances between the latitudinally spaced rows are the same, as noted by the letter"X" For example, in a tobacco rod of a nominal length of 70 mm,"X" is usually 14 mm and for tobacco rods of nominal lengths of 84 and 100 mm,"X" is usually 16.8 mm. In this arrangement, the paper can be pre-perforated and registration on a cigarette maker is not necessary because of the repeating pattern at preselected increments. Also, for a non-filtered cigarette, the cigarette can be lit from either end and the same controlled smoke delivery or tar reduction is achieved.

Figure 3:
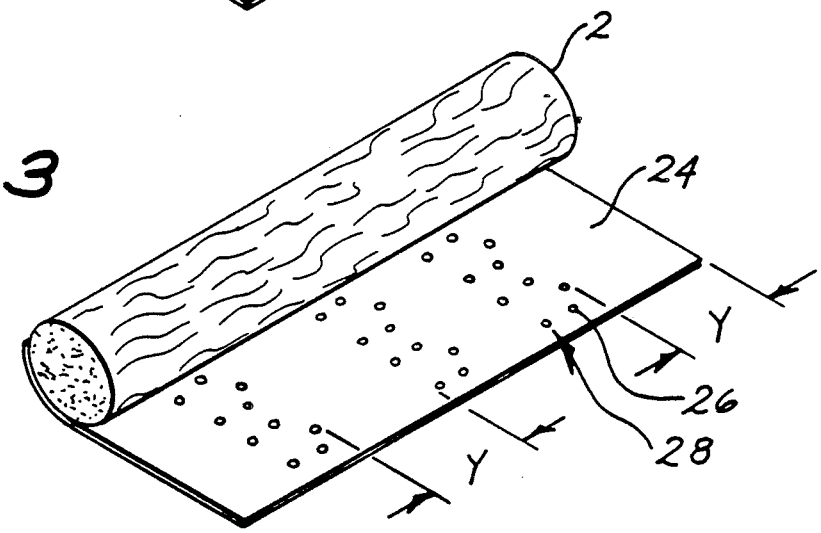

In FIG. 3, a tobacco rod 2 is circumscribed by a cigarette wrapping paper of the instant invention identified by the numeral 24. Wrapping paper 24 is provided by a plurality of apertures 26 therein which are arranged in a unique pattern as identified by the numeral 28. This unique pattern in FIG. 3 is: for example, the five points of a star. These repeating patterns 28 are latitudinally spaced equi-distance along the length of the wrapping paper as noted by the letter "Y". The spacing for these repeating patterns is the same as noted hereinbefore in regard to the latitudinal rows of perforations of FIG. 2.

FIGS. 2 and of the present invention show he wrapping paper as it is used to wrap a tobacco rod. It is realized that the products of FIGS. 2 and 3 may be used in their "unfiltered" condition as shown or filter tips may be added to the product to provide a filter-tipped cigarette.

It will be realized that various changes and other patterns may be made to the specific embodiment shown and described without departing from the principles of the present invention.

What is claimed is:

1. A cigarette wrapper comprising:

a plurality of at least three rows of perforations extending latitudinally across said paper, said perforations of each row being in alignment with each other, said rows of perforations being spaced apart from adjacent rows by the same preselected distance along the entire length of said paper, and each row of perforations includes a plurality of spaced apart preselected patterns of perforations, each of said patterns being separate and distinct from adjacent patterns, and including a plurality of perforations, and said patterns of each row being in alignment with each other.

2. The cigarette wrapper of claim 1, wherein said preselected pattern consists of a plurality of five perforations in a five points of a star-shaped configuration.

3. The cigarette wrapper of claim 1, wherein the distance from each end of the cigarette wrapper paper to the adjacent row of perforations is the same as the distance between each row of perforations spaced along the entire length of the paper.

4. The cigarette wrapper of claim 1, wherein the preselected distance between the rows of perforations is 14 mm.

5. The cigarette wrapper of claim 1, wherein the preselected distance between the rows of perforations is 16.8 mm.

* * * * *